US005111884A

United States Patent [19]

Striech et al.

[11] Patent Number: 5,111,884

[45] Date of Patent: May 12, 1992

[54] METHOD AND APPARATUS FOR REWORKING WELLS

[75] Inventors: Steven G. Striech; Ricky D. Jacobi, both of Duncan, Okla.; Daniel C. Herndon, Littleton, Colo.; Louis C. Floyd, Corpus Christie, Tex.

[73] Assignee: Halliburton Company, Duncan, Okla.

[21] Appl. No.: 727,714

[22] Filed: Jul. 10, 1991

[51] Int. Cl.[5] ..... E21B 23/02

[52] U.S. Cl. ..... 166/382; 166/387

[58] Field of Search ..... 166/382, 363, 372, 344, 166/386, 387, 217, 138

[56] References Cited

U.S. PATENT DOCUMENTS

| | | | |
|---|---|---|---|
| 4,060,131 | 11/1977 | Kinneday et al. | 166/382 |
| 4,248,300 | 2/1981 | Braddick | 166/386 |
| 4,372,393 | 2/1983 | Baker | 166/382 |
| 4,513,817 | 4/1985 | Weinberg | 166/138 |
| 4,600,058 | 7/1986 | Van Wormer et al. | 166/382 |
| 4,690,220 | 9/1987 | Braddick | 166/382 |
| 4,726,425 | 2/1988 | Smith, Jr. | 166/217 X |
| 4,834,184 | 5/1989 | Streich et al. | 166/376 |
| 4,993,493 | 2/1991 | Arnold | 166/382 |

*Primary Examiner*—Terry L. Melius
*Assistant Examiner*—Frank S. Tsay
*Attorney, Agent, or Firm*—James R. Duzan

[57] ABSTRACT

An improved method and apparatus for completing wells having corroded or leaking casing which are used as production and/or injection wells. The apparatus comprises a packer, an adapter assembly, and a stinger assembly installed in the well along with associated tubing strings to provide a new completion and production or injection string in the well.

11 Claims, 4 Drawing Sheets

METHOD AND APPARATUS FOR REWORKING WELLS

BACKGROUND OF THE INVENTION

This invention relates to an improved method and apparatus for completing wells More specifically, this invention relates to an improved method and apparatus for completing wells having corroded or leaking casing therein which are used as production and/or injection wells.

A typical method of reworking oil and gas wells or injection wells that have corroded or leaking casing comprises setting a packer at a desired location in the casing, stinging into the packer with a smaller string of tubing, setting a second packer inside the tubing string which is located in the packer set in the casing and stinging into the packer set in the tubing string attached to the packer set in the casing with a production or injection tubing string. In this manner, the annular space located between the tubing string and the packer set in the casing and the production or injection tubing string and the packer set in the tubing string is isolated and capable of being pressure tested to insure that there are no leaks in the production or injection tubing string or the packer set in the tubing string attached to the packer set in the casing. Typically, when desired, the annulus between the corroded or leaking casing and the small string of tubing connected to the packer set in said casing may be filled with cement to insure a fluid tight seal between said casing and said small string of tubing.

In a well that has been reworked in the above manner it is desirable, although possibly not possible, to be able to conveniently pull to production or injection tubing string, the packer set in the tubing string in the packer set in the casing, and the tubing string attached to the packer set in the casing.

SUMMARY OF THE INVENTION

The present invention relates to an improved method and apparatus for completing wells having corroded or leaking casing therein which are used as production and/or injection wells. The present invention comprises a packer, adapter assembly, and stinger assembly installed in the well along with associated tubing strings to provided a new completion and production or injection string in the well.

The various embodiments of the present invention will be more fully understood when the drawings are taken in conjunction with the detailed description of the invention.

DETAILED DESCRIPTION OF THE INVENTION

Figure 1A:
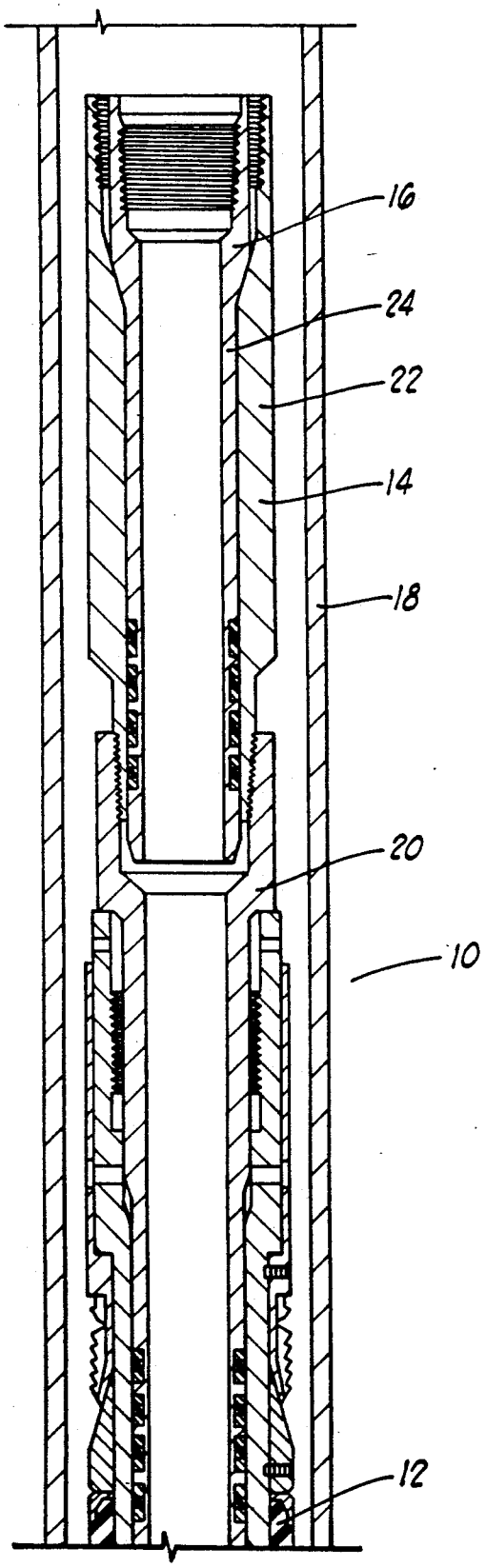
FIGS. 1A and 1B are a cross-sectional view of one embodiment of the present invention.
Figure 1B:
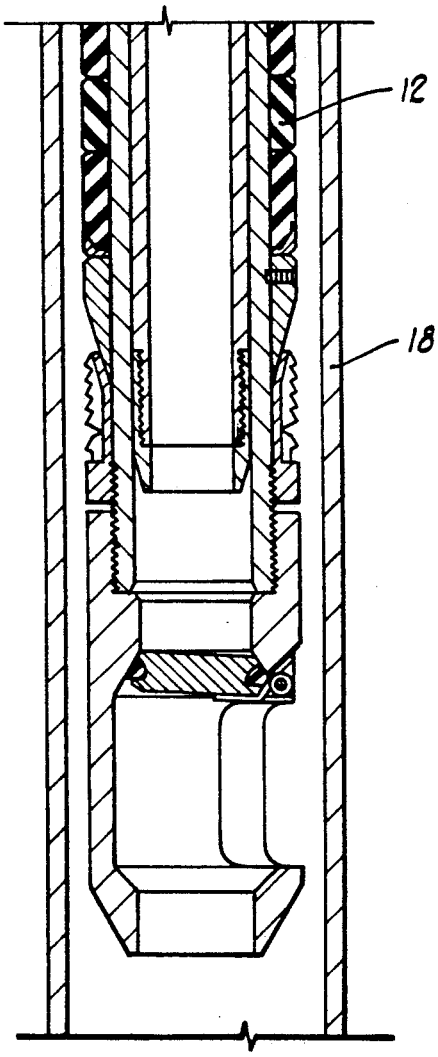

Referring to FIGS. 1A and 1B, the completion system 10 of the present invention is shown in a first embodiment. The completion system 10 comprises a packer 12, adapter assembly 14, and stinger assembly 16 installed in a well casing 18.

The packer 12 may be of any suitable production packer, such as described in U.S. Pat. No. 4,834,184 which is incorporated herein by reference.

The adapter assembly 14 comprises packer seal bore stinger 20 and production seal bore stinger receptacle 22.

The stinger assembly 16 comprises a stinger 24 and production tubing string (not shown).

Figure 2:
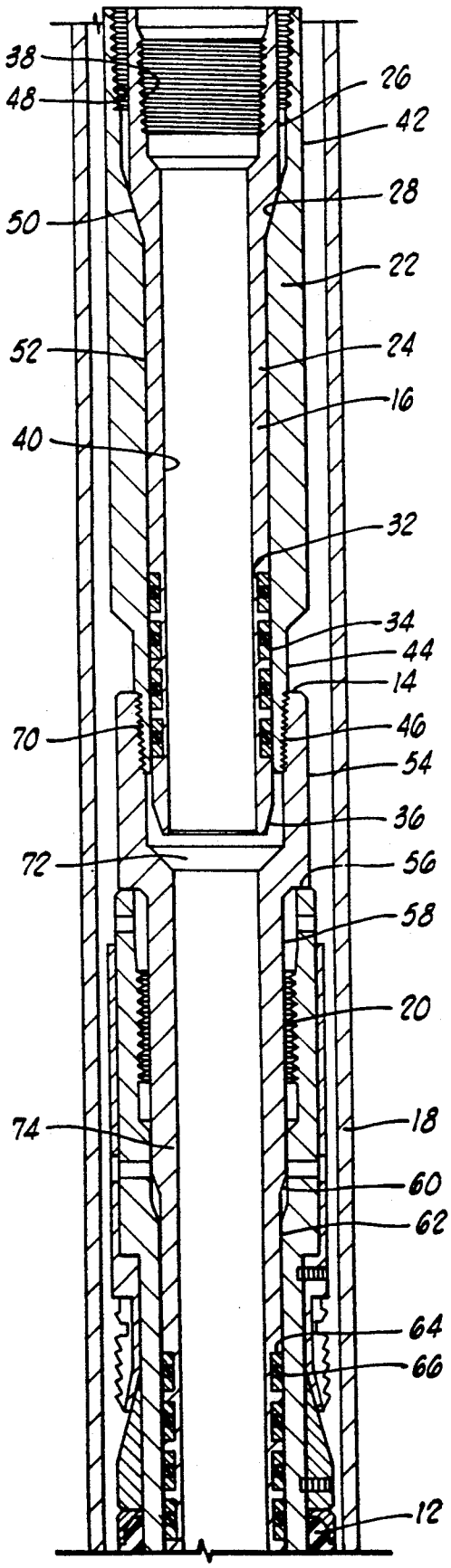
FIG. 2 is a cross-sectional view of a portion of the embodiment of the present invention shown in FIGS. 1A and 1B.

Referring to FIG. 2, the stinger assembly 16 is shown in more detail. The stinger 24 comprises an annular elongated cylindrical member having, on the exterior thereof, first cylindrical surface 26, first frusto-conical surface 28, second cylindrical surface 30 having, in turn, a plurality of annular recesses 32 therein containing a plurality of annular elastomeric seal members 34 and second frusto-conical annular surface 36 and having, on the interior thereof, threaded bore 38 which mates with the threaded pin connection of the tubing string (not shown) and bore 40 therethrough.

The production seal bore stinger receptacle 22 of the adapter assembly 14 comprises an annular elongated cylindrical member having, on the exterior thereof, first cylindrical surface 42, second cylindrical surface 44, and threaded surface 46 and having, on the interior thereof, threaded bore 48 which mates with threaded pin connector of a new casing string (not shown), frusto-conical annular surface 50 which serves as a seat for first frusto-conical annular surface 28 of stinger 24, and bore 52 which slidingly sealingly receives second cylindrical surface 30 having annular elastomeric seal members 34 thereon of stinger 24 therein.

Further shown in FIG. 2 is a portion of packer seal bore stinger 20. The packer seal bore stinger 20 comprises an annular elongated cylindrical member having, on the exterior thereof, first cylindrical surface 54, annular shoulder 56 which abuts the upper end of the packer 12 when the stinger 20 is installed therein, second cylindrical surface 58, first frusto-conical annular surface 60, third cylindrical surface 62 having, in turn, a plurality of annular recesses 64 therein containing annular elastomeric seal members 66 which slidingly sealingly engage the bore of the packer 12 when the stinger 20 is installed therein, and having, on the interior thereof, threaded bore 70 which receives threaded surface 46 of production seal bore stinger receptacle 22 therein, frusto-conical annular surface 72 and bore 74 therethrough.

Figure 3:
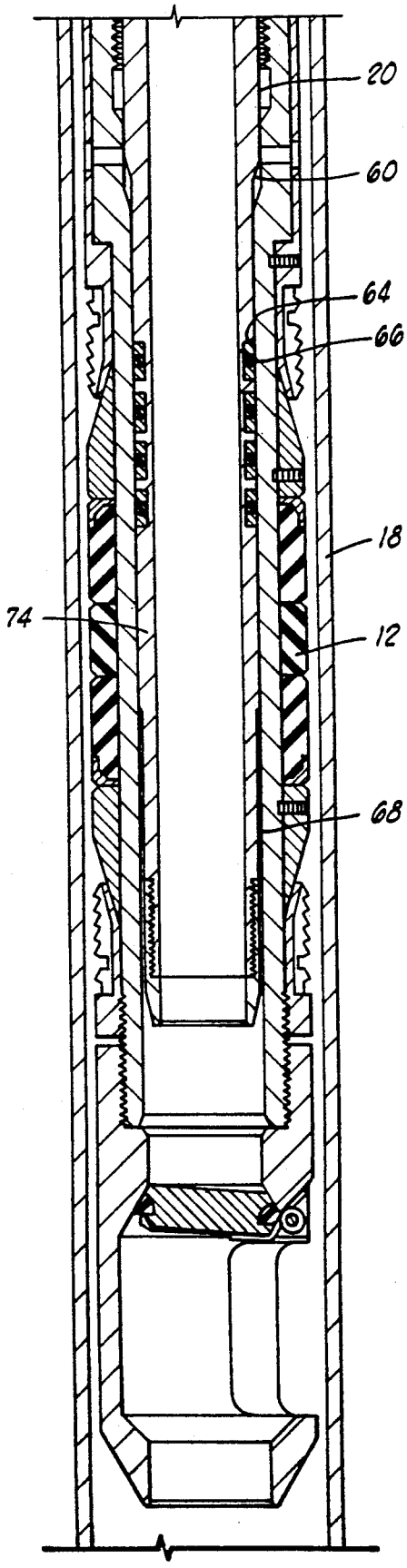
FIG. 3 is a cross-sectional view of another portion of the embodiment of the present invention shown in FIGS. 1A and 1B.

Referring to FIG. 3, the lower portion of the packer seal bore stinger 20 is shown in the packer 12 which the annular elastomeric seal members 66 slidingly sealingly engaging the bore of the packer 12.

Figure 4A:
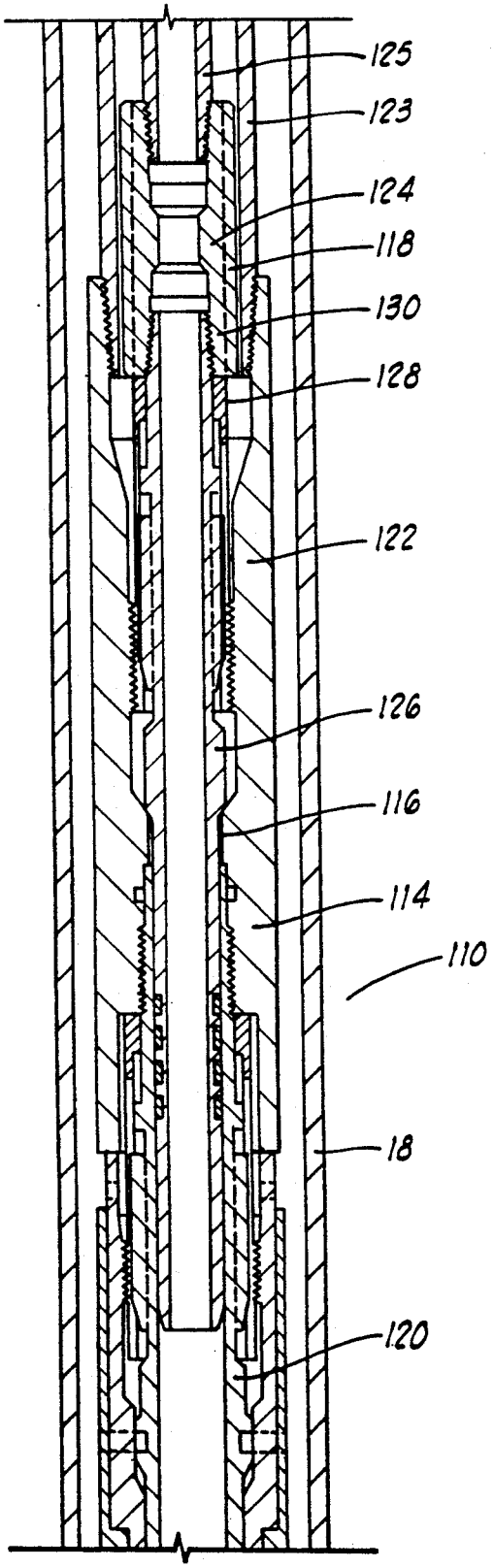
FIGS. 4A and 4B is a cross-sectional view of a second embodiment of the present invention.
Figure 4B:
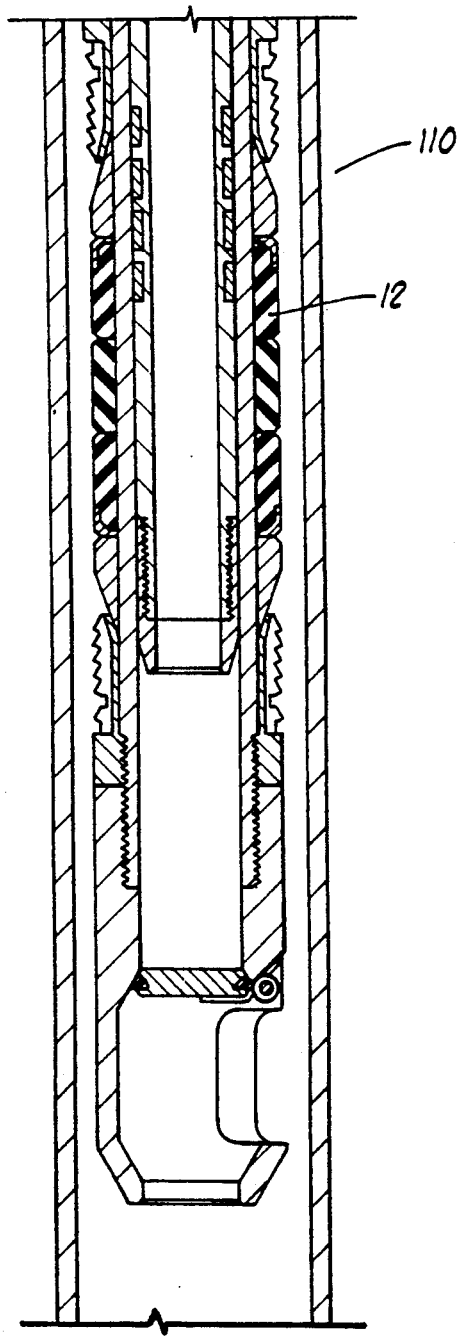

Referring to FIGS. 4A and 4B, the completion system 110 of the present invention is shown in a second embodiment. The completion system 110 comprises a packer 12, adapter assembly 114 and stinger assembly 116 installed in a well casing 18.

As shown in FIGS. 4A and 4B, the adapter assembly 114 comprises packer seal bore stinger 120 and production seal bore stinger receptacle 122 having new casing 123 connected thereto.

The stinger assembly 116 comprises a stinger assembly 124 and production tubing string 125.

Figure 5:
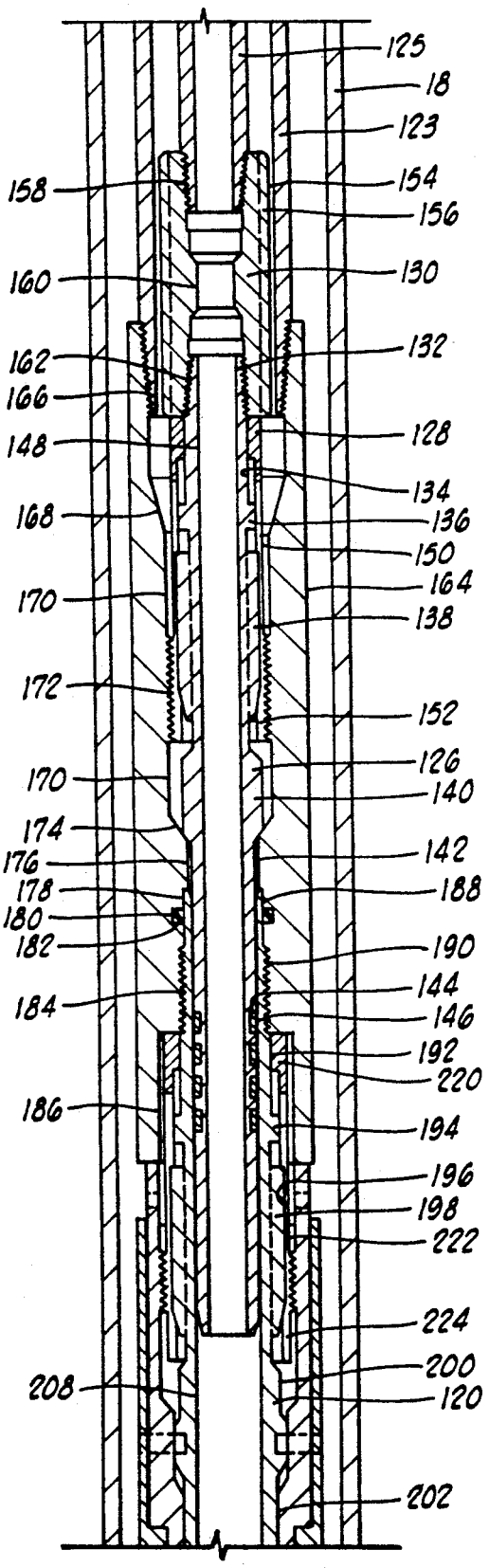
FIG. 5 is a cross-sectional view of a portion of the embodiment of the present invention shown in FIGS. 4A and 4B.

Referring to FIG. 5, the stinger assembly 124 is shown in more detail. The stinger assembly 124 comprises stinger mandrel 126, collet sleeve 128, fluted collar 130, and packer collet sleeve 220.

The stinger mandrel 126 comprises an annular elongated cylindrical member having, on the exterior thereof, threaded surface 132, first cylindrical surface 134, first annular lug 136, fluted annular collar 138, second annular collar 140 and second cylindrical surface 142 having, in turn, a plurality of annular recesses 144 therein containing a plurality of annular elastomeric seal members 146 and having, on the interior thereof, bore 148 therethrough.

The collet sleeve 128 comprises an annular cylindrical member having a plurality of collet fingers 150 therein, each collet finger 150 having threads 152 thereon. The collet sleeve 128 is slidingly retained on stinger mandrel 126 between first annular lug 136 and the bottom of fluted collar 130.

The fluted collar 130 comprises an annular cylindrical member having, on the exterior thereof, cylindrical surface 154 having, in turn, a plurality of flutes 156 therein and having, on the interior thereof, first threaded bore 158 which receives an end of production tubing string 125 therein, bore 160 and second threaded bore 162 which threadedly receives threaded surface 132 of stinger mandrel 126 therein.

The production seal bore stinger receptacle 122 comprises an annular elongated cylindrical member having, on the exterior thereof, cylindrical surface and having, on the interior thereof, first threaded bore 166 which threadedly receives an end of the new casing string 123 therein, first frusto-conical annular surface 168, first bore 170 having a plurality of lugs 172 extending inwardly therefrom which releasably engage the threads 152 on collet fingers 150 of collet sleeve 128, second frusto-conical annular surface 174 which serves as a seat for second annular collar 140 on stinger mandrel 126, second bore 176, third bore 178 having, in turn, annular recess 180 therein containing annular elastomeric seal member 182, second threaded bore 184 and fourth bore 186.

The portion of packer seal bore stinger 120 shown in FIG. 5 comprises an annular elongated cylindrical member having, on the exterior thereof, first cylindrical surface 188 which sealingly engages annular elastomeric seal member 182 of receptacle 122, threaded surface 190 which threadedly engages second threaded bore 184 of receptacle 122, second cylindrical surface 192 having, in turn, a plurality of first annular lugs 194 therein, third cylindrical surface 196 having, in turn, a plurality of flutes 198 therein, second annular lug 200 and fourth cylindrical surface 202 and having, on the interior thereof, bore 208 in which annular elastomeric seal members 146 sealingly engage.

Retained on packer seal bore stinger 120 within production seal bore stinger receptacle 122 is packer collet sleeve 220 comprising an annular cylindrical member having a plurality of collet finger 222 thereon, each collet finger 220 having an enlarged threaded head 224 thereon. The packer collet sleeve 220 is slidingly retained on stinger mandrel 126 between third cylindrical surface 196 and second annular lug 200.

Figure 6:
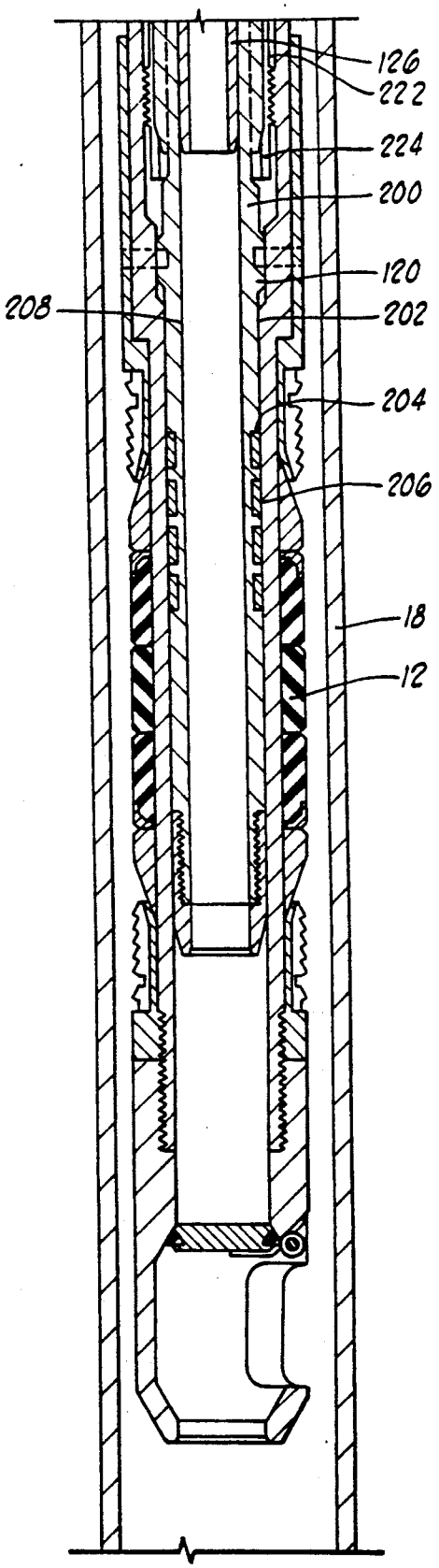
FIG. 6 is a cross-sectional view of another portion of the embodiment of the present invention shown in FIGS. 4A and 4B.

Referring to FIG. 6, the lower portion of the packer seal bore stinger 120 is shown. The lower portion of stinger 120 comprises an annular elongated cylindrical member having fourth cylindrical surface 202 having, in turn, a plurality of annular recesses 204 therein containing a plurality of annular elastomeric seal members 206 and having, on the interior thereof, bore 208.

OPERATION OF THE INVENTION

Referring to drawing FIGS. 1A and 1B, the operation of the first embodiment of the completion system 10 of the present invention will be set forth. The packer 12 is first run in the well casing 18 on a work string of tubing or pipe with an appropriate setting tool and set in the casing 18. As shown in FIGS. 1A and 1B the packer 12 has not been set in the casing 18.

After the packer 12 is set in the casing 18, the packer setting tool and work string are removed from the casing 18. Next, an adapter assembly 14 is assembled on the end of a new string of casing, to be run into the well casing 18 with the packer seal bore stinger 20 sealingly engaging the packer 12.

At this time, a new tubing string having a stinger assembly 16 on the end thereof is run into the new casing attached to the upper end of the production seal bore stinger receptacle 22 of the adapter assembly 14 until the stinger 24 sealingly engages the interior of the production seal bore stinger receptacle 22.

At this time, the well casing 18 has a new casing installed therein with a new production or injection tubing string installed within the new casing and the annulus between the new casing string and production or injection tubing string being capable of being pressure tested to ensure its integrity. Additionally, the completion system 10 of the present invention allows both the production or injection tubing string secured to the stinger assembly 16 and the new casing secured to the adapter assembly 14 to be removed from the well casing 18 without unsetting the packer 12.

Referring to drawing FIGS. 4A and 4B, the operation of the second embodiment of the completion system 10 of the present invention will be set forth. The packer 12 is first run in the well casing 18 on a work string of tubing or pipe with an appropriate setting tool and set in the casing 18. As shown in FIGS. 4A and 4B the packer 12 has not been set in the casing 18.

After the packer 12 is set in the casing 18, the packer setting tool and work string are removed from the casing 18. Next an adapter assembly 114 is assembled on the end of a new string of casing 123 to be run into the well casing 18 with the packer seal bore stinger 120 sealingly engaging the packer 12 and with the enlarged heads 224 on collet fingers 22 of packer collet sleeve 220 releasably engaging the interior of packer 12 thereby releasably latching the packer seal bore stinger 120 into the packer 12.

At this time, a new tubing string 125 having a stinger assembly 124 on the end thereof is run into the new casing attached to the upper end of the production seal bar receptacle 122 of the adapter assembly 114 until the stinger mandrel 126 slidingly sealingly engages the interior of packer seal bore stinger 120 and the enlarged heads 152 of the collet fingers 150 of collet sleeve 128 releasably engage the plurality of lugs 172 on the interior of production seal bore stinger receptacle 122 thereby releasably latching the stinger mandrel 126 to the receptacle 122.

At this time, the well casing 18 has a new casing 123 installed therein with a new production or injection tubing string 125 installed within the new casing 123 and the annulus between the new casing 123 and production tubing 125 being capable of being pressure tested to ensure its integrity. Additionally, the completion system 10 of the present invention allows both the production or injection tubing string 125 secured to the stinger assembly 124 and the new casing string 123 secured to the adapter assembly 114 to be removed from the well casing 18 without unsetting the packer 12.

Having thus described our invention, we claim:

1. A well completion apparatus for removably installing a new well casing string and a production tubing string in said new well casing string in a well bore having a casing installed therein; said well completion apparatus comprising:

a packer installed in said casing in said well bore, the packer having a plurality of lugs in the interior thereof;

an adapter assembly having a portion thereof releasably sealingly engaging the packer and having a portion thereof connected to said new well casing string; and a stinger assembly having a portion thereof releasably, sealingly engaging a portion of the adapter assembly and having a portion thereof connected to said production tubing string.

2. The well completion apparatus of claim 1 wherein the adapter assembly comprises:

a packer seal bore stinger; and a production seal bore stinger receptacle.

3. The well completion apparatus of claim 1 wherein the stinger assembly comprises:

a stinger; and said production tubing string connected thereto.

4. The well completion apparatus of claim 1 wherein:

the adapter assembly comprises:

a packer seal bore stinger; and a production seal bore stinger receptacle; and the stinger assembly comprises:

a stinger; and a production tubing string.

5. The well completion apparatus of claim 1 wherein the stinger assembly comprises:

a stinger mandrel;

a collet sleeve located on a portion of the stinger mandrel;

a fluted collar connected to one end of the stinger mandrel; and a packer collet sleeve located on another portion of the stinger mandrel.

6. The well completion apparatus of claim 1 wherein:

the adapter assembly comprises:

a packer seal bore stinger having a portion thereof slidingly sealingly engaging a portion of the packer; and a production seal bore stinger receptacle attached to a portion of the packer seal bore stinger; and the stinger assembly comprises:

a stinger mandrel;

a collet sleeve located on a portion of the stinger mandrel;

a fluted collar connected to one end of the stinger mandrel; and a packer collet sleeve located on another portion of the stinger mandrel.

7. The well completion apparatus of claim 1 wherein:

the adapter assembly comprises:

a packer seal bore stinger having a portion thereof slidingly sealingly engaging a portion of the packer; and a production seal bore stinger receptacle attached to a portion of the packer seal bore stinger and having a plurality of lugs in the interior thereof; and the stinger assembly comprises:

a stinger mandrel;

a collet sleeve located on a portion of the stinger mandrel, the collet sleeve adapted to releasably engage the plurality of lugs in the interior of the production seal bore stinger receptacle;

a fluted collar connected to one end of the stinger mandrel; and a packer collar sleeve located on another portion of the stinger mandrel, the packer collet sleeve adapted to releasably engage the plurality of lugs in the interior of the packer.

8. A method of completing a well having a casing in a well bore having fluid therein using a well completion apparatus, the method comprising;

installing a packer in said casing in said well bore;

installing an adapter assembly on an end of a string of new casing;

running the string of new casing having the adapter assembly installed thereon into said casing in said well bore;

engaging a portion of the adapter assembly with the packer installed in said casing in said well bore;

installing a stinger assembly on one end of a string of production tubing;

running the string of production tubing having the stinger assembly thereon into the string of new casing in said casing in said well bore; and engaging a portion of the stinger assembly in a portion of the adapter assembly.

9. The method of claim 8 further comprising:

producing said fluid in said well bore from below the packer through the string of production string.

10. The method of claim 8 further comprising:

removing the string of production tubing having the stinger assembly thereon from the string of new casing in said casing in said well bore.

11. The method of claim 8 further comprising:

removing the string of new casing in said casing in said well bore while the packer remains installed in said casing in said well bore.

* * * * *